United States Patent [19]

Herold et al.

[11] 4,123,481

[45] Oct. 31, 1978

[54] DEVICE FOR CARBURETION OF LIQUID FUELS

[76] Inventors: Wilhelm Herold, Biebererstr. 27, D-6055 Hausen; Johannes Pickert, Fichtenweg 2, D-6057 Dietzenbach, both of Germany

[21] Appl. No.: 821,023

[22] Filed: Aug. 1, 1977

Related U.S. Application Data

[63] Continuation of Ser. No. 569,609, Apr. 21, 1975, abandoned.

[30] Foreign Application Priority Data

Feb. 21, 1975 [DE] Fed. Rep. of Germany ..... 2507495

[51] Int. Cl.[2] ..... F02M 27/08

[52] U.S. Cl. ..... 261/81; 123/198 E; 239/102

[58] Field of Search ..... 239/102, 4; 261/DIG. 48, 1, 81; 123/198 E

[56] References Cited

U.S. PATENT DOCUMENTS

| | | | |
|---|---|---|---|
| 2,532,554 | 12/1950 | Joeck | 261/DIG. 48 |
| 2,791,994 | 5/1957 | Grieb | 261/DIG. 48 |
| 2,907,648 | 10/1959 | Chapman | 261/DIG. 48 |
| 2,949,900 | 8/1960 | Bodine | 261/DIG. 48 |
| 3,155,141 | 11/1964 | Doyle et al. | 261/DIG. 48 |
| 3,284,762 | 11/1966 | Kompanek | 261/DIG. 48 |
| 3,292,910 | 12/1966 | Martner | 239/102 |
| 3,357,641 | 12/1967 | Martner | 239/102 |
| 3,533,606 | 10/1970 | Thatcher | 261/DIG. 48 |
| 3,677,236 | 7/1972 | Moss | 261/DIG. 48 |
| 3,756,575 | 9/1973 | Cottell | 261/DIG. 48 |
| 3,804,329 | 4/1974 | Martner | 239/102 |
| 3,893,434 | 7/1975 | Thatcher et al. | 261/DIG. 48 |
| 3,904,347 | 9/1975 | Rokudo et al. | 261/DIG. 48 |

FOREIGN PATENT DOCUMENTS

| | | | |
|---|---|---|---|
| 2,318,779 | 10/1973 | Fed. Rep. of Germany | 261/DIG. 48 |
| 723,797 | 2/1955 | United Kingdom | 261/DIG. 48 |

*Primary Examiner*—Tim R. Miles
*Attorney, Agent, or Firm*—Edwin E. Greigg

[57] ABSTRACT

A device for carburetion of liquid fuels including an ultrasonic oscillator and at least one fuel supply nozzle which supplies fuel into engagement with the oscillator. The oscillator is disposed in an air tube so that the fuel which is acted upon by the oscillator can be mixed with air to form a fuel-air mixture.

9 Claims, 16 Drawing Figures

DEVICE FOR CARBURETION OF LIQUID FUELS

This is a continuation of application Ser. No. 569,609, filed Apr. 21, 1975, now abandoned.

The invention relates to devices for carburetion of liquid fuels and for developing a gaseous fuel-air-mixture by means of oscillation energy in the ultrasonic range supplied in a mixing tube which is disposed upstream of one or more combustion chambers and in which at least one injection or spray nozzle of an injection means is provided, which is supplied with fuel by means of a pumping device.

Devices for carburetion of liquid fuels and for generation of a gaseous fuel-air-mixture are known, which are disposed upstream of a combustion chamber and in which at least one injection nozzle of an injection means is provided, which is supplied with fuel by means of a pumping device. Such devices are found in various forms in nearly all types of combustion engines, for example in the Otto carburetor engine (spark ignition engine), in turbines, or in heating equipment of the type which operates on liquid fuel.

In all these combustion engines and heating plants which operate on liquid fuel, there exists the problem of converting the liquid fuel into its vapor phase as completely as possible and at the same time to mix the fuel with a sufficient quantity of air resp. oxygen in the most uniform manner, so that a most uniform and complete combustion may be achieved in the combustion chamber. At present, however, this objective has not been achieved by far with combustion engines as well as with heating plants of any kind.

The fuel-air-mixture required for operation of spark ignition engines is generated by so called "carburetors" which, however, strictly speaking do not convert the fuel into its gaseous phase, but rather develop an atomized mixture by means of the air intake, in which the liquid fuel is distributed in an air stream in the form of small droplets. One attempts to vaporize the small liquid particles during their passage to the cylinder by absorption of heat. This, however, mainly succeeds only with such liquid particles which contact the tube walls with resultant heat exchange during their passage to the cylinder. This, however, constitutes only a small percentage of the liquid particles, so that the major part of the fuel droplets arrive at the combustion chamber in liquid phase. The percentage of the liquid particles contacting the wall may be increased by generating a turbulent flow from the mixing tube to the cylinder; for this, however, a considerable energy is required to generate the turbulent flow.

A further possibility for vaporizing the fuel consists in the use of a Venturitube, in which there is a large pressure drop by means of a constriction and the resultant increased flow rate existing thereat, so that a lowered pressure relative to the environment exists, by which the liquid fuel is drawn out of the fuel supply tube and is vaporized. Here also liquid droplets are supplied to the combustion chamber, so that an incomplete combustion is caused which contributes to environment pollution to a considerable extent.

Corresponding considerations also apply to present commercial heating equipment.

There have already been attempts to utilize ultrasonic oscillation energy for improving the atomization and vaporization of liquid fuels.

However, in using ultrasonic energy for the atomization and vaporization (gasification) of liquid fuels difficulties arise with respect to coupling, i.e. with regard to the problem of transferring the oscillation energy into the liquid phase of liquid droplets moving in a gas. When an ultrasonic wave encounters an interface, for example as is present between an oscillating metal body excited by a transmitter and a liquid, a discontinuous change of the impact wave resistance occurs at the interface and the wave is partially or even totally reflected. In this nearly similar laws as in light optics apply. The impact wave resistances of metals on one hand and of liquids on the other hand differ very strongly, so that the reflection coefficients at the interfaces of these two types of substances are nearly always larger than 90%. This means that substantially total reflection exists, e.g. between metal and air, because here the impact wave resistances become larger by several orders of magnitude, so that the reflection coefficient becomes nearly one. Therefore, none or only very little oscillation energy can be transferred from a solid body to the low density air and vice versa, because a good transfer presupposes that the kinetic energy of the oscillating mass of the heavy body is nearly equal to the mass of the light gas. This means that the gas would have to oscillate with a much larger amplitude than the heavy metal, which however is not readily possible for reasons of continuity at the interface. Therefore the mechanical coupling factor is determined by the ratio of the impact wave resistances. For these reasons in the past it has only been attempted to transfer ultrasonic energy into a pure liquid phase to atomize resp. to vaporize the liquid fuel.

From U.S. Pat. No. 2,791,994 a device is known, in which ultrasonic energy is used for mixing a liquid with a gaseous substance. In this device a controlled and focussed ultrasonic energy field is transferred to a material at the location of its introduction into the gas flow, in order to maintain the laminar flow of the material during the process of atomization which is present in a continuous phase. In this the ultrasonic oscillator has such a configuration, that the ultrasonic energy is focussed on the tip of the nozzle from which the fuel is sprayed. In this known device, therefore, the ultrasonic energy is transferred from a solid body to a gaseous phase substance and from this is transferred to a liquid phase substance. With this, however, the above described difficulties arise, so that only a very small portion of the oscillation energy passes into the liquid phase, since a total reflection occurs as a result of the different impact wave resistances between metal and air. Furthermore, correspondingly high losses also occur in the transfer of the sound energy from the gaseous substance into the liquid.

Therefore the invention has the object to provide a device for carburetion or gasification of liquid fuels and for mixing with oxygen, preferably atmospheric oxygen, by means of mechanical oscillations in the ultrasonic range generated by an oscillating device, wherein a relatively large ultrasonic energy is directly transferred to the fuel present in liquid phase which is vaporized thereby and is directly subsequently mixed with oxygen or air.

This object is achieved in accordance with the invention in the above mentioned devices for carburetion of liquid fuels by each injection nozzle being directed onto one or more impingement surfaces for energy transfer with the droplets, said surfaces being disposed in the mixing tube and capable of being supplied with oscillation energy, so that the fuel jet or spray exiting from an injection or spray nozzle is subject to an energy transfer with its associated impingement surface. The energy transfer is especially large, if the main jet direction of an injection nozzle extends parallel to the normal of its associated impingement surface, i.e. the fuel jet is nearly orthogonally directed onto the impingement surface. Since however, in addition a good mixing with the air flowing through the mixing tube should take place, depending on the design, it may be of advantage that the main jet direction of an injection nozzle forms an angle between 0° and 90° with the normal of its associated impingement surface, preferably an angle of 45°.

An advantageous mixing occurs, if the main jet direction of an injection nozzle is either normal or parallel to to main flow direction of the air in the mixing tube.

The normal of an impingement surface may be disposed orthogonally or also in parallel to the main direction of the flow in the mixing tube.

For the purpose of opening and closing the injection nozzle in accordance with the invention an injection device is provided which is controllable by a pulse source having a controllable pulse output. The control means for controlling the pulse source in this is advantageously coupled with a control means for controlling a choke plate disposed in the mixing tube. By this measure in accordance with the invention the control of the fuel supply by means of a float is not necessary and thus the disadvantages associated with the float are avoided. Advantageously the injection or spray nozzle is in flow communication with a fuel tank through a controllable fuel pump, wherein the fuel pump exerts a pressure of appr. 2 to 4 atmospheres. However, depending on given conditions this pressure may be decreased or increased.

In accordance with the invention a pulse source for controlling the injection nozzle is adapted for mutually independent variation of:

(a) the time period $t_1$, in which the injection nozzle is opened, and (b) the time period $t_2$ in which the injection nozzle is closed.

In accordance with the invention the impingement surface is formed as an ultrasonic oscillator and consists of a piezoelectric ceramic body. In this it is advantageous to form the ultrasonic oscillator either as a flexural bending mode oscillator either fixed at one side, or with a mounting at the ends with free rotary movement, or mounting on both sides or a mounting in the oscillation nodes with free rotary movement. It is also of advantage to form the ultrasonic oscillator as a compound transducer in which a piezoelectric ceramic disk or plate is joined with a metal disk or plate in such a manner, that the fuel jet or spray impinges on the metal disk. In view of wear it is preferred to manufacture the metal disk or plate from stainless steel.

The object of the invention is also achieved by a device for carburetion of liquid fuels and for mixing with oxygen or air by means of an oscillation device performing mechanical oscillations in the ultrasonic range, which is coupled with respect to oscillations with shaped metal bodies for transfer of oscillations where the metal body forming a carburation and/or a mixing chamber forms a cup shaped oscillator body and where also at least one fuel injection nozzle is disposed in the carburetion and/or mixing chamber having a spray cone of such shape and location, that at least a major portion of the sprayed fuel contacts the surfaces of the oscillator body.

According to the invention at least one fuel supply nozzle is disposed in the bottom and/or in the side wall of the cup shaped oscillator body.

As a result of the cup like shape of the oscillator body in accordance with the invention the side walls of that body perform longitudinal as well as transverse oscillations, wherein standing waves form within the space enclosed by the cup shaped oscillator body and in addition this wave space is supplemented by those radiated from the bottom of the cup. By reason of this a large number of regions containing wave antinodes form within this cup like space, and these regions are passed by those fuel droplets sprayed by the fuel nozzles which do not impinge on the side walls of the cup shaped oscillator body.

In a further embodiment of the invention at least one air supply opening in form of a hole, a slit or a nozzle is disposed in the side wall and/or in the cup bottom of the cup shaped oscillator. Advantageously several air supply openings are located in the side wall of the oscillator and in a plane parallel to the cup bottom, so that the space enclosed by the side walls of the oscillator body is acted upon in the utmost possible uniform manner by the air supplied. It is of advantage in achieving this objective to dispose several air supply openings in the side wall of the oscillator body in several planes above each other and vertically displaced by a determined angle.

In a further embodiment of the invention the central axes of air supply nozzles are directed towards the central axis of the cup shaped oscillator and form an angle with the plane parallel to the bottom of the cup which is smaller than 90° and larger than 0° and preferably is 45°. By this means the mixture is improved and simultaneously a flow component in the direction of the central axis of the cup shaped oscillator is created.

A particularly advantageous turbulent flow may be generated within the cup shaped oscillator by directing the central axes of the air supply nozzles or openings located in the sidewall of the oscillator body onto a line section which extends from the central axis of the cup shaped oscillator to its side wall. In this manner at the same time the path is advantageously lengthened, which by the droplet portion of the fuel must travel within the carburetion and mixing space, so that the probability of passing through an oscillation antinode or of impinging on a side wall is increased. Furthermore, a centrifugal force becomes effective through the generation of a turbulent or swirl flow in the carburetion and mixing space, which acts upon the droplets of the liquid contained in the flow and carries these to the walls of the space.

In a further embodiment of this feature at least two axes of the air supply nozzles or openings intersect in the carburetion or mixing space in such a manner, that several turbulent air flows develop in the space, depending on the number of pairs of air supply nozzles.

According to the invention it is of advantage to associate the fuel supply nozzles with the air supply nozzles or openings in the walls of the cup shaped oscillator in such a manner, that the supplied fuel is first subjected to a carburetion and then to a mixing.

Advantageously the oscillator device for converting electromagnetic oscillations into mechanical oscillations comprises piezo ceramic components, which consist of modified lead-circonium-titanate and are joined with the metal bodies to form a mechanically prestressed transducer containing one end section of high sound intensity and one end section of low sonic intensity. In this the oscillator device is formed as a compound oscillator with one or more screw joints. The end section with high sonic intensity in a further embodiment of the invention is formed as a mechanical transformer so that a transformation from a large oscillating area with small amplitude adjacent to the source to a small radiating area oscillating with a large amplitude can be performed. The oscillating device according to the invention, which is formed as a compound oscillator with a mechanically prestressed transducer is provided with a mounting flange at its end section with smaller sonic intensity. As a result advantageously only a relatively low damping of the oscillator device is caused by the mounting means.

In accordance with the invention the cup shaped oscillator body is coupled for sound transmission to the end section having high sonic intensity in such a manner that the cup bottom can be excited to plate waves. In one embodiment of the invention the cup shaped oscillator body is threaded onto the end section having high sonic intensity, wherein the upper side surfaces of the oscillator body are provided with interior threads which are engaged with threads on the upper side surfaces of the end section. According to the invention it is also possible to surround the cup bottom of the oscillator body with a shell integral with the oscillator body.

For the purpose of improving the air supply to the carburetion and/or mixing space formed by the cup shaped oscillator body, an air deflection means projecting into the air flow channel is located downstream of the air supply openings which are adjacent to the air flow channel. In this the air deflection means may be formed as a truncated cone shell having smaller openings with a diameter equal to the outer diameter of the cup shaped oscillator body, where the latter is joined with the truncated cone shell, e.g. by threads or a cement.

A more detailed explanation of the invention is given by several embodiments in connection with the drawings, which show:

FIG. 1 a cross section of a mixing tube provided with an injection or spray device and an impingement surface according to the invention, FIG. 2 a cross section through a mixing tube of a different embodiment in which the longitudinal axis of the injection nozzle is coaxial with the longitudinal axis of the mixing tube.

FIG. 3 shows a cross section through a mixing tube similar to the tube of FIG. 2, however with a different direction of fuel injection, FIG. 4 a cross section of a mixing tube with several injection devices arranged coaxial with the air flow, FIG. 5 a cross section of a mixing tube suitable for heating equipment, FIG. 6 a cross section of a combustion chamber with radially arranged mixing tubes, FIG. 7 a section which is normal to FIG. 1, in schematic form, FIG. 8 a block diagram illustrating the combination of the pulse source with the injection device, FIG. 9 a curve of the output voltage of the pulse source plotted over the time axis, FIG. 10 a cross section through the device for carburetion of liquid fuels for heating equipment, FIG. 11 a modification of the device of FIG. 10, FIG. 12 a schematic cross section of a cup shaped oscillator body, FIG. 13 an embodiment similar to the one of FIG. 12 with several fuel supply nozzles in the carburetion and mixing space, FIG. 14 a plan view of the device of FIG. 13, FIG. 15 a further embodiment of the invention similar to those represented in FIGS. 12 and 13, FIG. 16 a plan view of the device according to FIG. 15.

FIG. 1 shows a mixing tube which has an injection or spray nozzle 3 of an injection device inserted through its wall. An impingement surface 5 is disposed, so that it is opposing the injection nozzle 3 and is integrally joined to an electromechanical transducer 6. In the embodiment as shown here a piezo electric ceramic body is used as an electromechanical transducer, which is excited to radio frequency oscillations by a transmitter or source which is not shown in detail. The transmitter or source is adjusted to a fixed frequency which may be in the range between 40 and 240 kilocycles. Depending on its design the output power of the oscillator is 80 to 100 watts.

In the mixing tube 1 a choke plate 4 is located at the air intake end and is coupled to a control means and to a pulse source as explained in more detail below in connection with FIG. 8. The output side of the mixing tube 1 for example leads to the discharge knee or intake manifold of a spark ignition engine which is not shown in further detail.

The fuel jet exiting from the fuel nozzle 3 and consisting of fine fuel droplets is guarded against deflection by the air flow by means of a cover 21 (ref. FIG. 7) in order to ensure that the fuel droplets impinge on the impingement surface 5. From this it can be recognized that the inflowing air is permitted to flow between the wall of the mixing tube and the cover 21 without deflecting the fuel jet in its passage from the fuel nozzle 3 to the impingement surface 5. Only the gases developed by the impingement on the impingement surface are carried over by the intake air.

FIG. 2 shows an embodiment in which a portion of an injection device 7 with the injection nozzle 3 is located within a mixing tube 1. Within the mixing tube 1 and opposite to the injection nozzle 3 an impingement surface 9 is located which is excited to ultrasonic oscillations by an electromechanical transducer. In this embodiment a line normal to the impingement surface 9 is parallel to the direction of flow of the air and to the major flow direction of the fuel discharging from the fuel nozzle 3. In addition the choke plate 4 is located in the mixing tube 1 at its intake end. Obviously, the transducer 8 and impingement surface 9 are supported within the mixing tube 1 by a spider, as otherwise fluid flow could not proceed as indicated in this figure.

FIG. 3 shows a further embodiment which is similar to the one according to FIG. 2. Again a portion of an injection device 10 with an injection nozzle 3 is located within a mixing tube 1 and is opposed by an impingement surface 9 which is excited to oscillations by an electromechanical transducer 8. In this embodiment the direction of flow of the fuel exiting from the injection nozzle is opposed to the flow direction of the intake air. In the embodiments of the FIGS. 2 and 3 no cover 21 needs to be provided since the flow of the fuel jet is parallel to the air flow. In both cases only the gas developed from the fuel droplets at the impingement surface 9 is carried over.

FIG. 4 shows a further embodiment of the invention, in which several injection devices 11 and 13 with their associated impingement surfaces 12 and 14 and the corresponding transducers are disposed around a mixing tube. The fuel gases developed by the impingement surfaces 12 and 14 are introduced into the mixing tube at the side and it is of advantage to provide an airfoil body 15 in the region where the fuel gases enter into the mixing tube, so that the flow velocity is increased in this region and the static pressure is decreased. A suction effect on the generated fuel gases is caused by this decrease of the static pressure, so that these mix with the air and are carried along with it.

FIG. 5 shows a schematic representation a further embodiment of the invention similar to the embodiment of FIG. 1 which, however, is especially suitable for use in heating equipment with liquid fuels. Here also an injection device 16 is contained in a mixing tube and is disposed opposite an impingement surface 17 together with an electromechanical oscillator 18. Since in this embodiment the fuel jet directed onto the impingement surface 17 is orthogonal to the direction of the inflowing air, it is necessary to provide a cover 26, so that the fuel jet consisting of still liquid droplets is not already deflected by the inflowing air. The cover approximately corresponds to the cover shown schematically in FIG. 7 and designated by the reference number 21.

FIG. 6 shows a further embodiment in which several mixing tubes with corresponding injection devices 16, impingement surfaces 17, and electromechanical oscillators 18 are arranged around a common combustion space 19. Such a device is especially suitable for large heating plants for generation of heat or steam power for turbines or the like.

FIG. 7 shows a schematic representation of the location of a cover 21 relative to the fuel jet inside a mixing tube 1.

FIG. 8 shows the combination of an injection device 2 with a pulse source 23 and its control 22. The control 22, which in a motor vehicle for example may be the gas pedal, is coupled with a choke plate 24. A fuel pump 4 supplies fuel from a tank 25 to the injection nozzle 3 under a pessure, e.g. of 2 to 4 atmospheres.

The fuel pump 24 is controllable, so that the pressure, with which the liquid fuel is injected into the mixing tube, may be varied. The pulse source 23 is designed such, that for the purpose of controlling the injection device 2 the period $t_1$ in which the injection nozzle 3 is open and the period $t_2$, in which the injection nozzle 3 is closed, may be independently varied. In this connection reference is made to FIG. 9 in which $t_1$ designates the pulse width which also designates the period in which the injection nozzle 3 is opened.

The pulse train designated by $t_2$ means also the period in which the injection nozzle 3 is closed.

In using the mixing tube according to the invention for a heating plant it is not necessary to make the control periods variable in case the plant is intended for operation with constant power. On the other hand in the application to a vehicle motor the opening and closure periods of the injection nozzle must be variable in order to control all ranges of power, like idling, acceleration, normal load and full load.

Piezo electric ceramic bodies are especially suitable as electromechanical transducers, since they can be manufactured in all suitable shapes, so that the various forms of oscillations may also be generated. Of course additionally also the known quartz oscillators and magnetostrictive oscillators can be used.

FIG. 10 shows a cross section through a device for carburetion of liquid fuels and for mixing with the atmospheric oxygen, in which a cup shaped oscillator body 102 is excited to ultrasonic frequency oscillations by a piezo ceramic oscillator. To this end the electrodes 119 and 120 are electrically connected to a generator 136. The oscillator 110 also consists of several components and preferably is constructed as a compound oscillator. In the embodiment depicted here the piezo ceramic components 110 consist of two disks arranged above each other, e.g. each having an outer diameter of 38 millimeters, and having a central hole for insertion of a bolt 113, for example of 12.5 millimeters. For example each disk may have a thickness of 6.3 millimeters. The bolt 113 is provided with threads 121 and corresponding threads are contained in the metal body 111, the threads 121 of the bolt 113 engaging in these and causing a tension joint of the metal bodies 112 and the piezo ceramic components 110. The piezo ceramic components 110 also consist of a modified lead-circonate-titanate and together with the metal form bodies 111 and 112 form a mechanically prestressed transducer, wherein the metal body 111 or metal body 112 form an end section with either high or low sonic intensity. Modified lead-circonate-titanates are oxydic materials with which particular large mechanical oscillation amplitudes may be obtained, because the mechanical and dielectric losses of these materials are extremely low. The bolt 113 preferably consists of steel, while the metal bodies 111 and 112 preferably consist of aluminium. For the metal bodies an alloy of aluminium-copper-magnesium-lead may also be used and for the electrodes 119 and 120 suitably an alloy of copper with beryllium is used. The bolt 108 is provided with a mechanical prestress, e.g. of 2.5 kilograms. A cylindrical element 102 is threaded onto the metal body 111 forming the end section with high sonic intensity, said element 102 forming a cup shaped oscillator body with the surface 105 of the metal body 111, having side walls 106 which enclose a carburetion and mixing space 100. Openings 107 are provided in the side wall 106 of the cup shaped oscillator body 102 which are uniformly spaced over the periphery of the sidewall 106. An air deflection body 117 is secured to the sidewall 106 above the openings 107, e.g. by screws, cementing or in other suitable ways, and preferably is at a position, in which an oscillation node is located; this position depends on the size and the frequency used.

An oil supply conduit 122 leads into a hole 123 provided in the metal body 111. The hole ends in the bottom of the cup in a nozzle 103 having a spray cone 104. Preferably this is formed in such a manner in relation to the openings 107 in the wall 106 that the sprayed oil already impinges on the walls 106 below the openings 107.

The whole oscillator device consisting of the piezo ceramic oscillators 110, the metal bodies 111 and 112, as well as the cup shaped oscillator 102 and the oil supply conduit is contained in an air flow channel 115 defined by the outer air guide 124. In the embodiment shown here the whole oscillator device is joined to a metal disk 116 by means of a bolt 113 and is secured to a flange 125 with the air channel enclosure 124. The portion of the metal disk 116 contained in the flow channel 115 is provided with openings 126 to ensure a passage for the air flow. The size of the openings is variable for regulating the air flow, for example by means of an aperture not shown in detail.

For the purpose of igniting the fuel air mixture contained in the carburetion and mixing space 100 which is also discharged therefrom, ignition electrodes 127 and 128 are provided in front of this space which are secured to the air channel enclosure 124 at 129 and 130.

The air flow in the channel 115 is generated by means of a blower, not shown in detail, and the flange 125 of the air channel enclosure also serves as a mounting flange for attachment to the support of a combustion space, for example of the boiler of a heating plant.

According to the invention the end section of the metal form body 111 having high sonic intensity is shaped as a mechanical transformer, where a transformation from a source side, large oscillating area, namely the cross section of the metal body 111, which is oscillating with a relatively small amplitude, to a small area oscillating with a large amplitude, namely the cross sectional area of the side wall 106 of the cup shaped oscillator 102, is achieved. The excitation of the side walls 106 is caused by the metal body 111 in the form of longitudinal waves and because of the small cross section of the side walls 106 transverse waves develop at the same time which are radiated into the space 100 and generate standing waves therein. Depending on the dimensions and on the frequency used a number of antinodes and nodes are developed along the wall 106 and a corresponding oscillation pattern also results in the space 100 enclosed by the wall 106. It is ensured by means of the nozzle 103, that the oil sprayed out under a given pressure impinges on the wall 106 of the oscillating body 102 and an exchange of energy occurs thereat which is sufficient to overcome the cohesive forces of the oil droplets and to vaporize or to gasify these. Immediately after this the gas or the eventual still existing fine droplets containing oil spray enters into an air flow entering through the passages 107 which are directed in such a manner, that a swirling effect occurs in the space 100. This on one hand causes a centrifugal force to be developed, whereby the still heavy parts in the form of oil droplets are thrown against the wall 106, and on the other hand the length of travel in the carburetion space 100 is increased such that the probability of impingement of the droplets on the wall 106 is increased. After the gas is mixed with the inflowing air this mixed flow passes the electrodes 127 and 128 where an ignition spark occurs therebetween and continuously ignites the mixture.

FIG. 11 shows a further embodiment of the invention. The cup shaped oscillator 102 in this is integral with the metal body 111. Three alternative mountings are shown by FIG. 11 of which only one is used optionally. The first type of mounting corresponds to the mounting of FIG. 10 by means of a metal disk 116, which is joined and prestressed with the oscillator device by means of the bolt 113 and is attached to the flange 125 of the air channel enclosure. A further mounting arrangement of the oscillator device is obtained by a flange 131 secured to the lower metal body 112 with a flange connection to a corresponding counter flange on the air channel enclosure 124.

The third mounting arrangement results from a three-point suspension, each point being an oscillation nodal point on one of the metal bodies 111 or 112. As a result of the choice of a nodal point for the mounting only a relatively small damping of the oscillator device occurs.

In FIG. 12 a cup shaped oscillator body 102 is schematically shown having a cup bottom 105 which is formed as a flexural bending mode oscillator. The cup shaped oscillator 102 is attached to the metal body 111 for example by means of screws or using a cement. Therefore, a cup shaped oscillating body is acoustically coupled to the metal body 111 having high sonic intensity, wherein the cup bottom 105 is excited to plate wave oscillations. Therefore, the cup shaped oscillator body 102 represents a flexural bending mode oscillator excited from its periphery. The excitation takes place from the metal body 111 which oscillates in form of longitudinal waves in the direction of its major axis. The area 133 of the metal body 111 is bordered by air, so that here substantially total reflection occurs, since the impact wave resistances of metals on one hand and of air on the other hand differ very strongly, namely by several orders of magnitude, so that the reflection coefficient becomes nearly one. Thereby the smaller area 134 becomes the radiating area which is acoustically coupled with the cup shaped body 102. For this purpose the cup shaped oscillator body 102 is bolted to the metal body 111.

Figure 1:
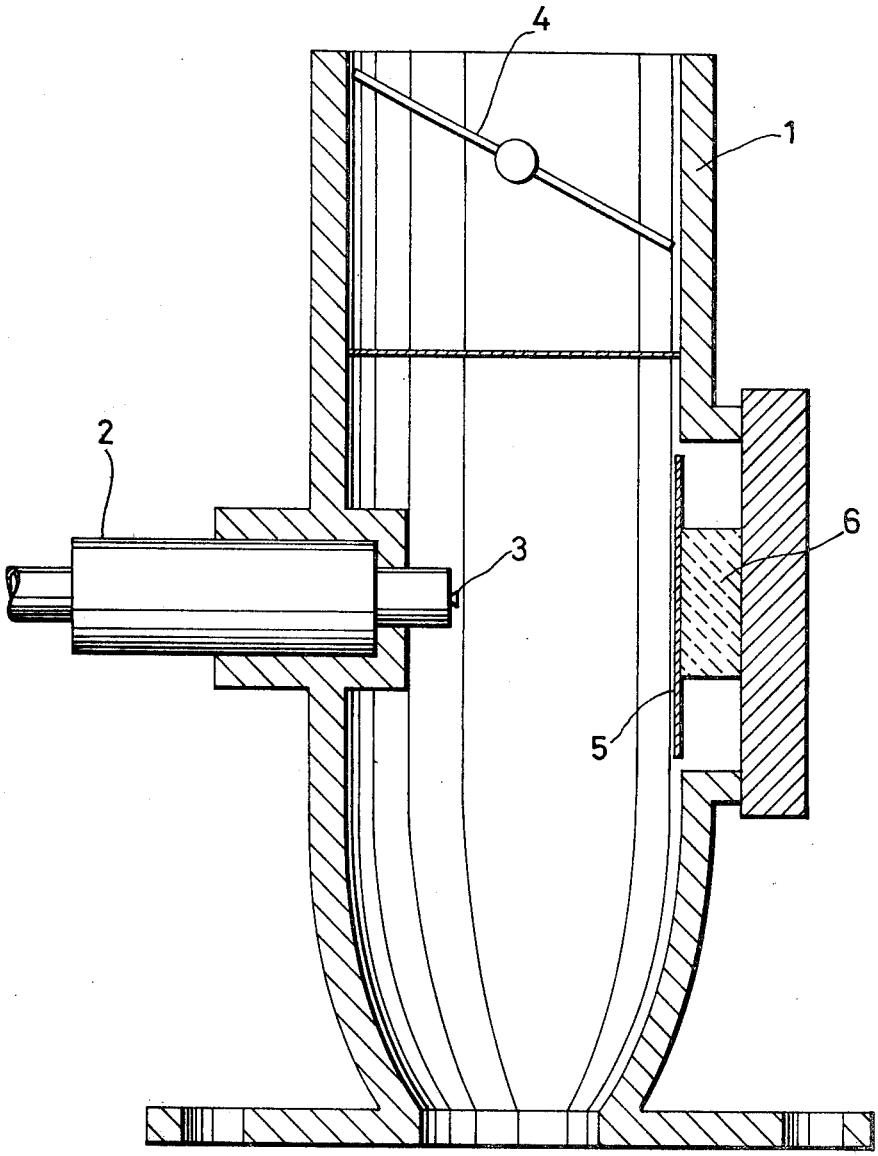
Figure 2:
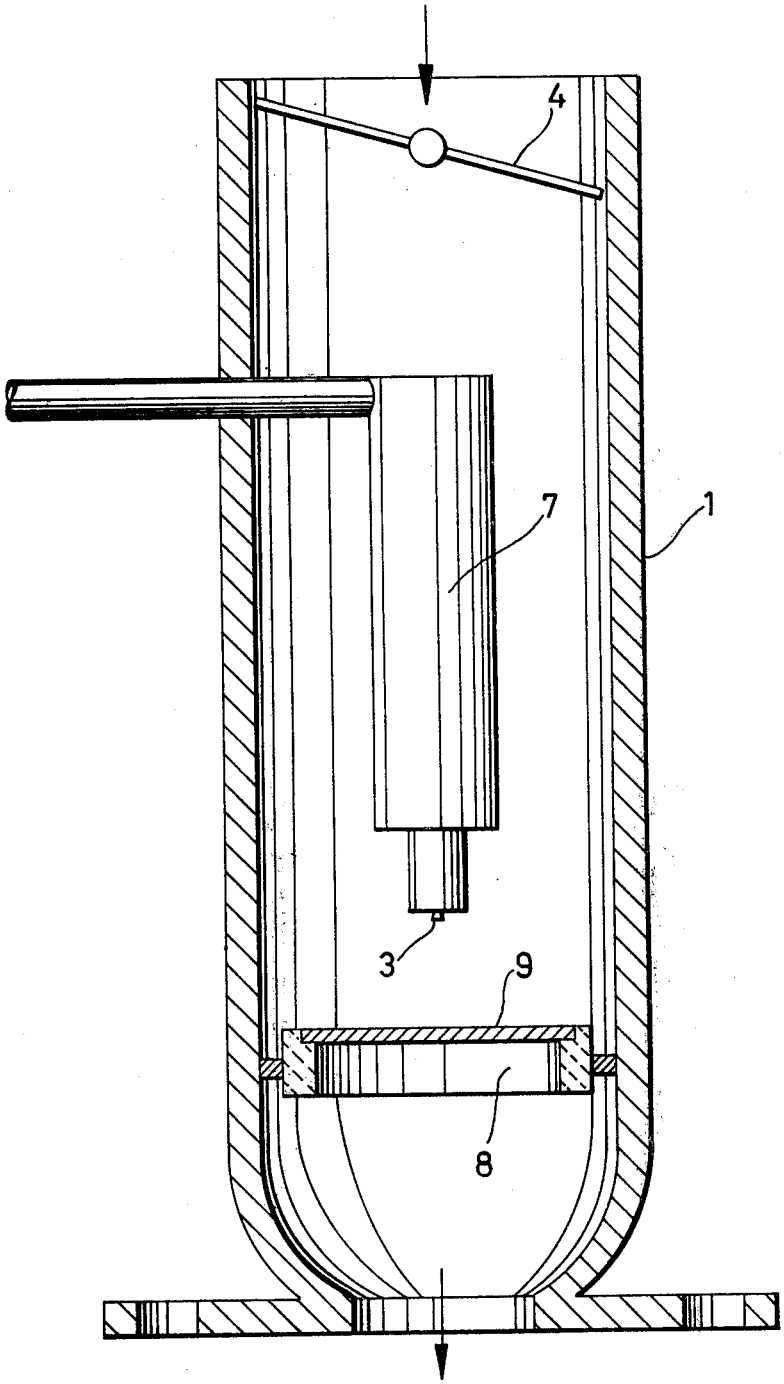
Figure 3:
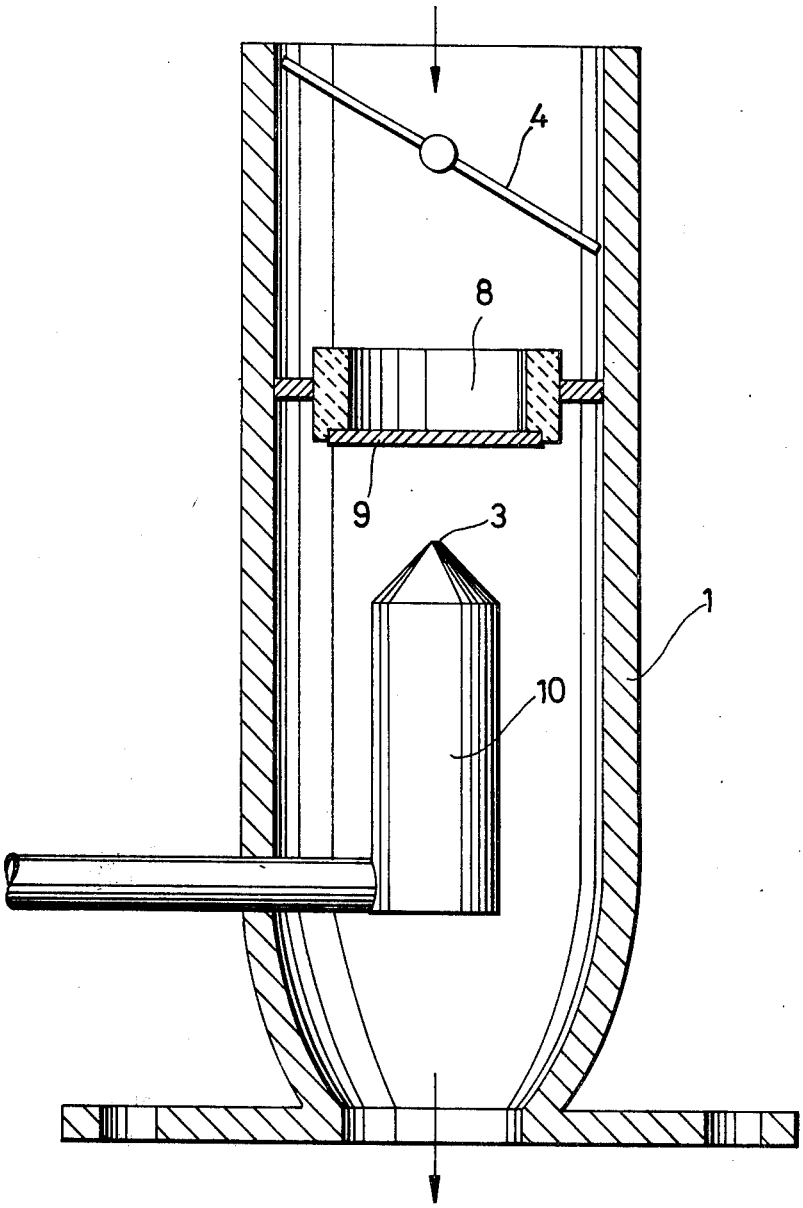
Figure 4:
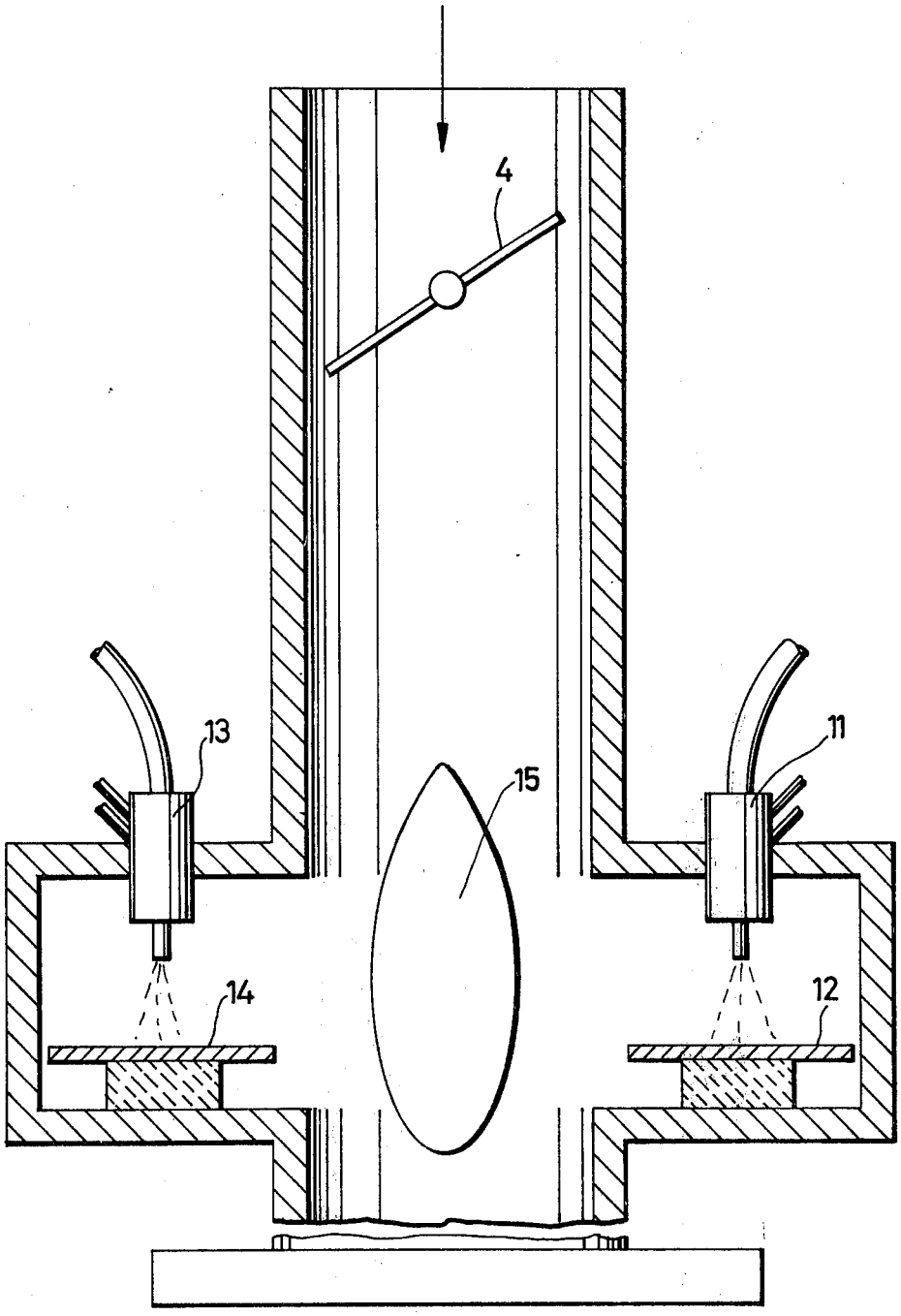
Figure 5:
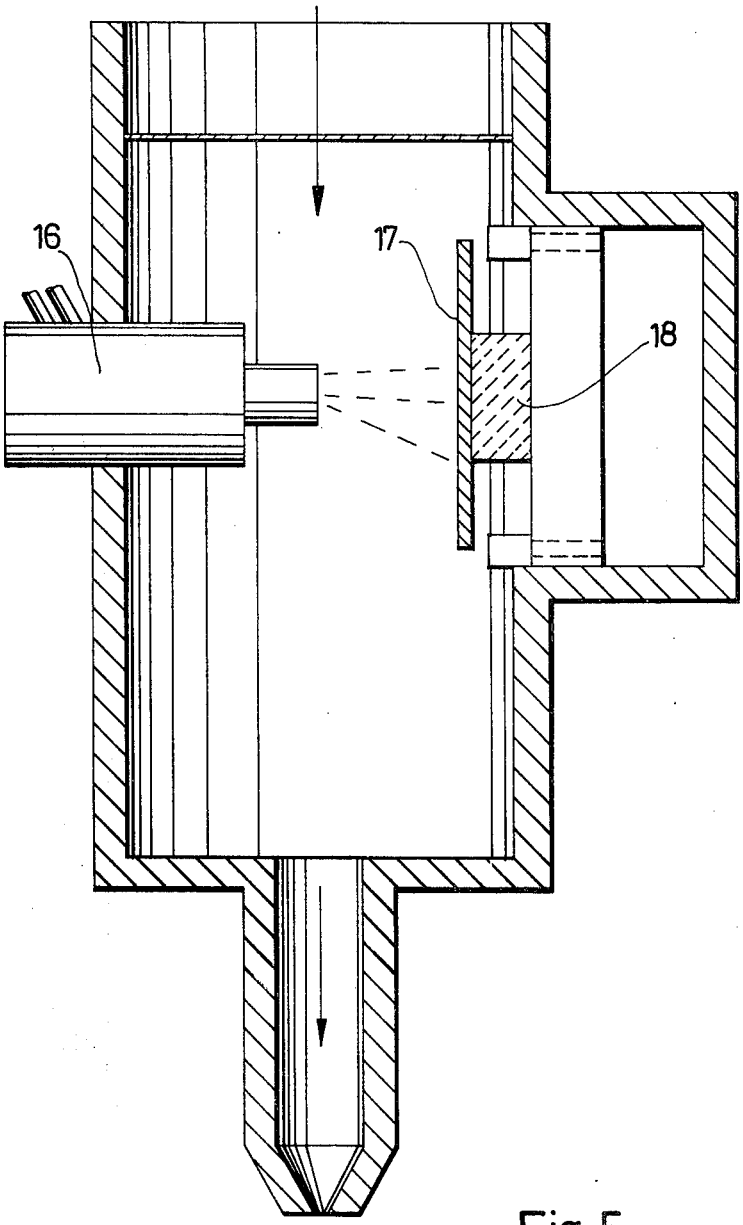
Figure 6:
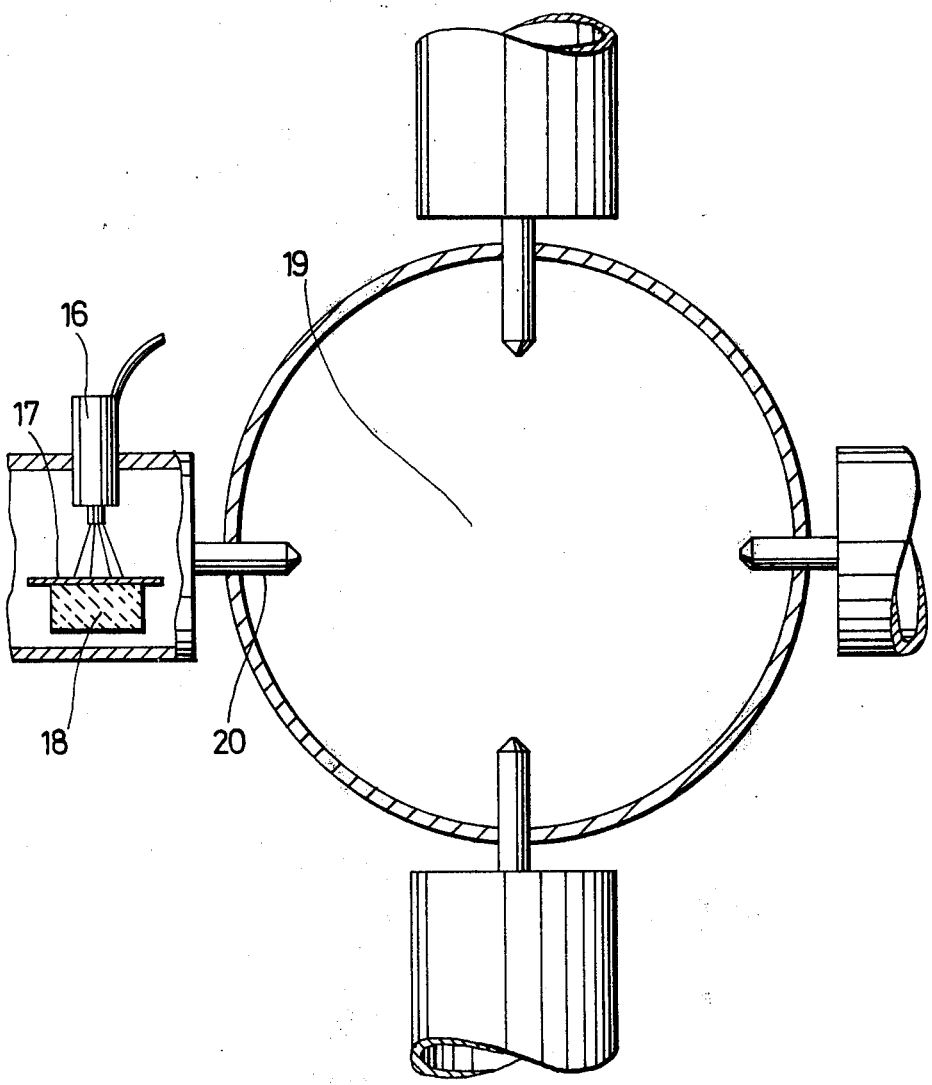
Figure 7:
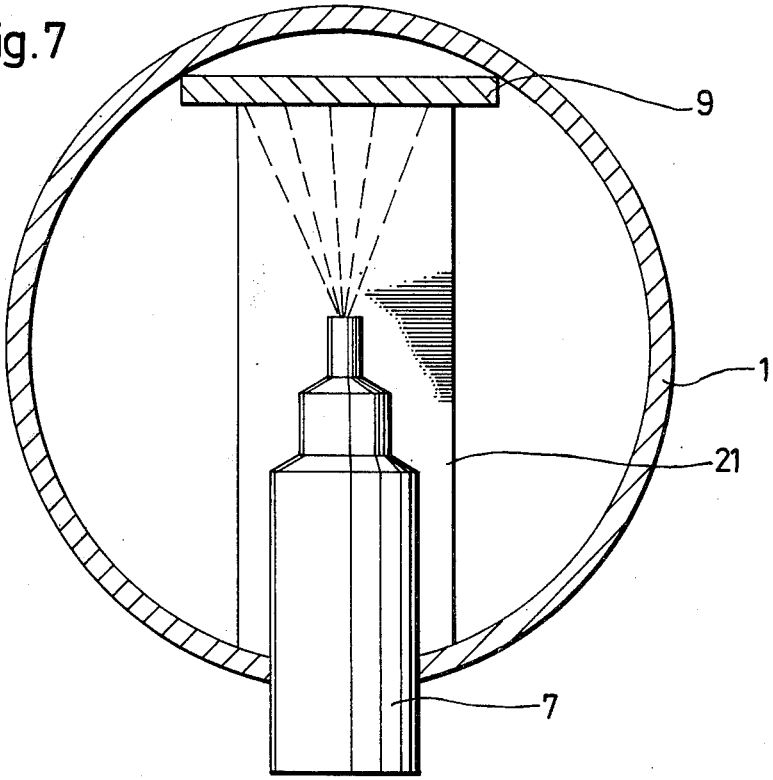
Figure 8:
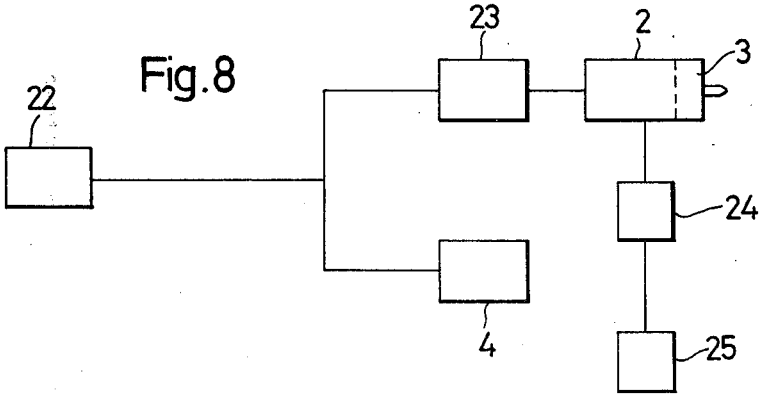
Figure 9:
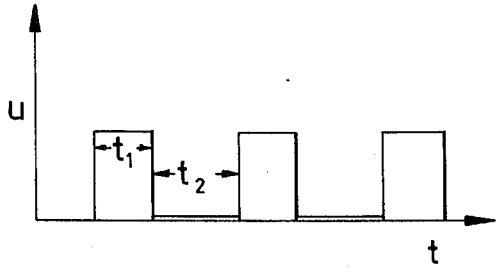
Figure 10:
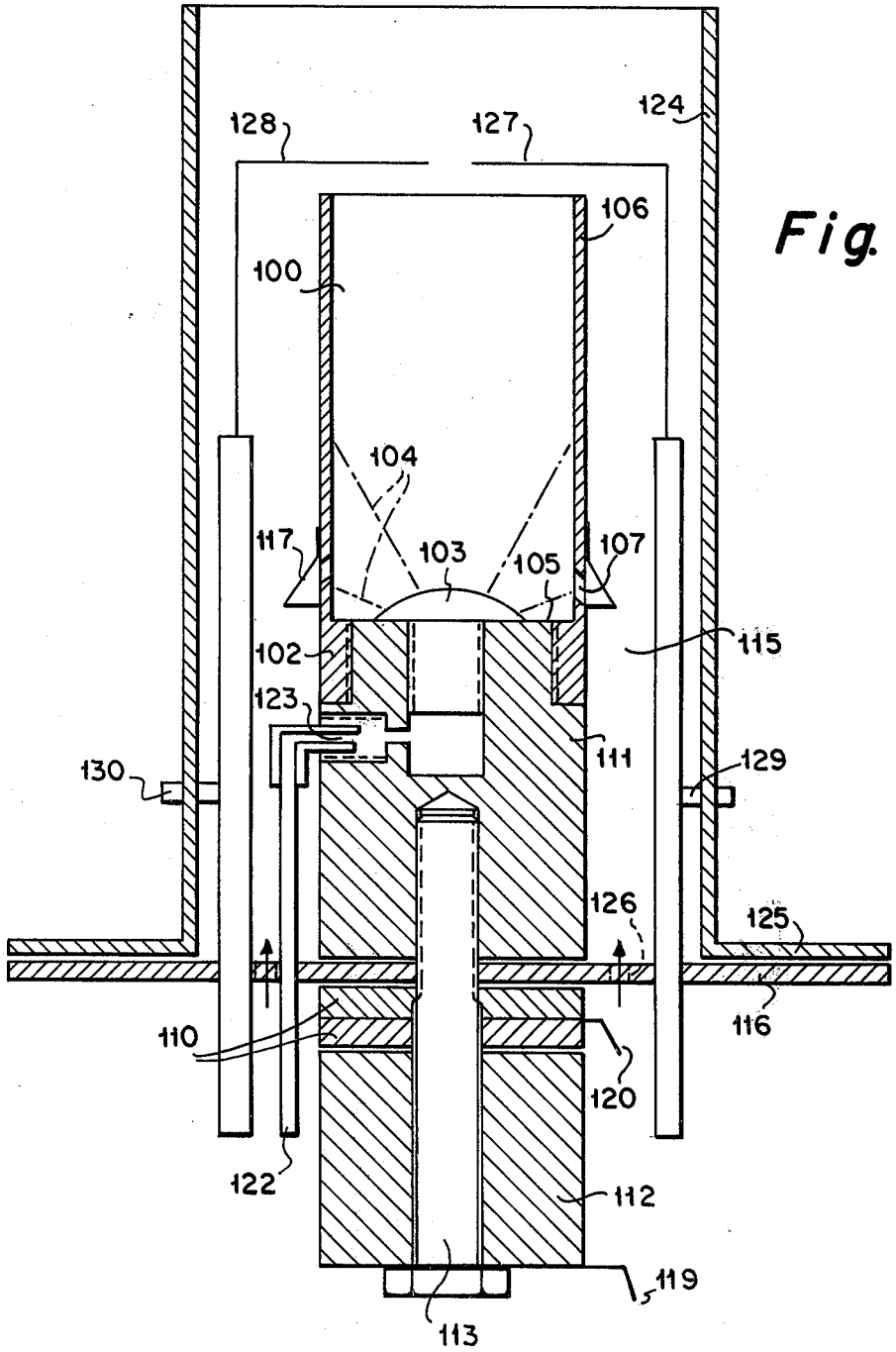
Figure 11:
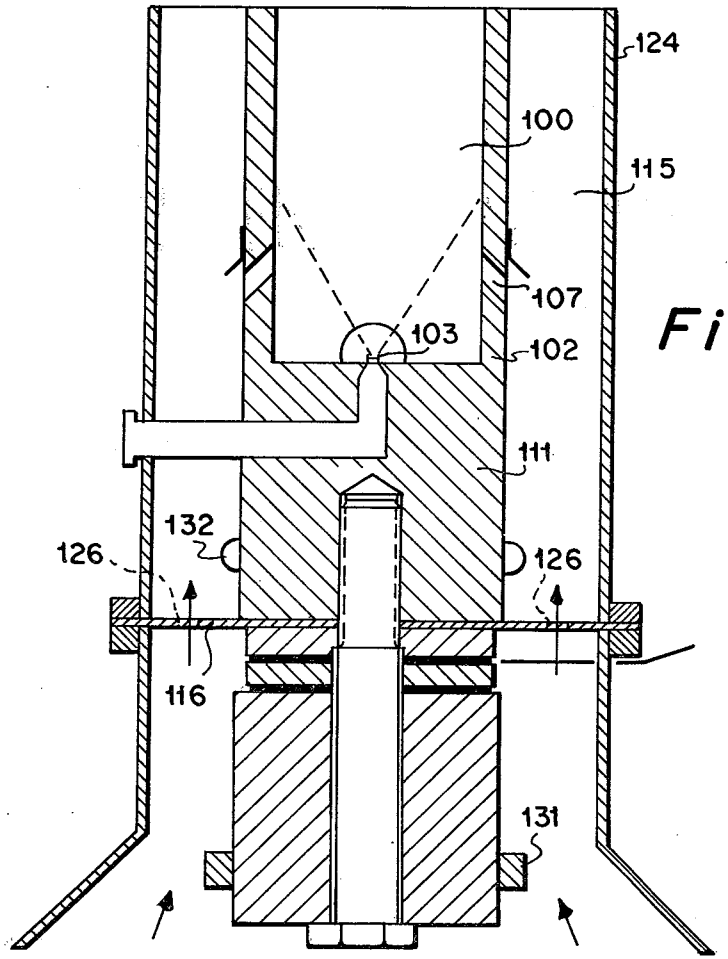
Figure 12:
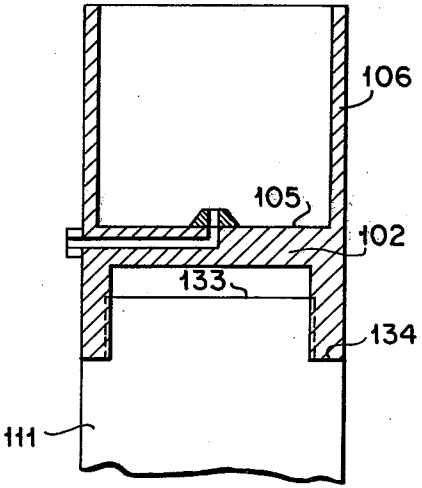
Figure 15:
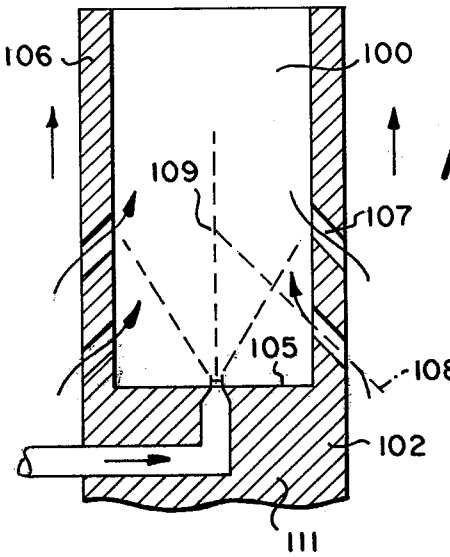
Figure 16:
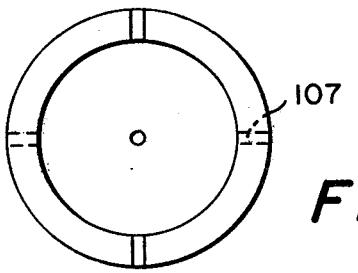
Figure 13:
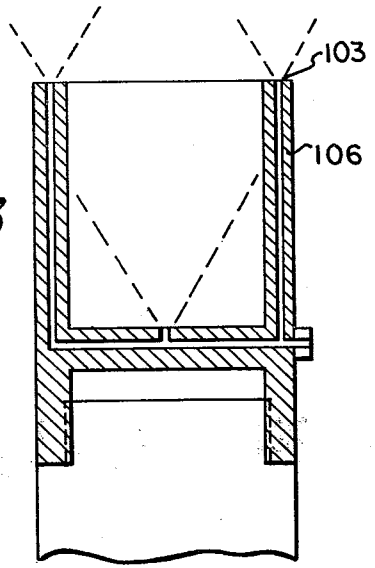
FIG. 13 shows an embodiment of the invention similar to the one in FIG. 12; however, in this several fuel injection nozzles are provided in the cup bottom of the oscillator 102 as well as in its side wall 106.
Figure 14:
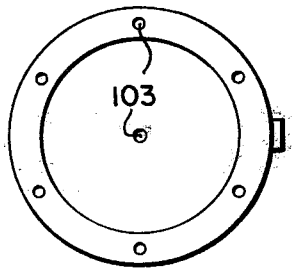
FIG. 14 shows the geometrical arrangement of the fuel injection nozzles 103.

In FIGS. 15 and 16 a cup shaped oscillator body 102 is shown in a further embodiment and is an integral part of the metal body 111. In this embodiment several air supply nozzles 107 are arranged above each other in the wall 106. The central axes of the air supply nozzles 107 in this form an angle of 45° with the central axis 109 of the cup bottom of the oscillator 102.

For the purpose of generating a turbulent flow or swirl in the combustion chamber 100 the central axes of the air supply nozzles 107 may also be directed onto a line section extending from the central axis 109 to the wall 106. In case of an equal direction of all central axes 108 a single turbulent flow is generated. However, it is also possible to direct the central axes 108 of two air supply nozzles in each instance in such a manner, that a number of turbulent flows corresponding to the number of pairs of nozzles are established.

By using a cup shaped oscillator relatively large oscillating areas with large oscillating amplitudes for the oil droplets in the space enclosed by the cup shaped oscillator are developed and simultaneously the portion of those oscillations radiated into this space and forming standing waves therein is also utilized. Thus, not only an energy transfer is obtained by the direct contact between the oil droplets and the walls, but the fine oil spray and the oil droplets in passing the space pass the antinodes of the standing waves and are forced into an exchange of energy thereat. In this manner an extremely advantageous carburetion of the liquid fuels is obtained, whereby the efficiency of the device for carburetion or gasification of liquid fuels is considerably increased.

The invention can be used for the carburetion of all liquid fuels and is not only suitable for use with stationary or mobile combustion devices, but also for spark ignition engines and Diesel engines.

Even crude oil and used oils may be used, as resulting from the lubrication of machines. The solid residues present in used oil must be removed by filtering.

What we claim is:

1. A device for carburetion of liquid fuels comprising:
an airflow tube;
an oscillatory body disposed within said tube, said body terminating in a cup-shaped portion opening toward the down-stream end of said airflow tube, said cup-shaped portion having at least one air inlet opening through the side wall thereof;
an electro-mechanical transducer coupled to said oscillatory body;
a fuel supply nozzle disposed in the bottom of said cup-shaped portion for spraying fuel onto the inner walls thereof;
means affording connection of said nozzle to a source of liquid fuel under pressure; and
means for connecting said transducer to a source of electrical energy.

2. A device as defined by claim 1 in which said transducer is a piezo-electric ceramic body formed as a flexural bending mode oscillator.

3. A device as defined by claim 1 in which the air inlet openings in the side wall of said cup-shaped portion have their axes disposed at an angle to the plane of the cup bottom of about 45°.

4. A device as defined by claim 1 in which the axes of the air openings through the side wall of said cup-shaped portion are angularly disposed with respect to each other to produce a swirling motion of air within said portion.

5. A device as defined by claim 1 in which the air openings through the side wall of said cup-shaped portion are so positioned with respect to said fuel supply nozzle that the fuel is first gasified by oscillatory energy from said body and then mixed with air.

6. A device as defined by claim 1 in which said transducer is a modified lead-zirconate-titanate and said body is metallic.

7. A device as defined by claim 1 in which said body comprises a solid cylindrical portion and a cup-shaped portion, said cylindrical portion with the larger cross-sectional area oscillating at a small amplitude and said smaller cross-sectional area cup-shaped portion oscillating with a large amplitude.

8. A device as defined by claim 1 in which said oscillatory body comprises a solid cylinder and a cylindrical cup threadedly joined in an integral structure.

9. A device as defined by claim 1 in which said oscillatory body comprises a solid cylinder and a cylindrical cup which are integrally formed.

* * * * *